US006893187B2

(12) United States Patent
Lehto et al.

(10) Patent No.: US 6,893,187 B2
(45) Date of Patent: May 17, 2005

(54) EXPANSION JOINT STRUCTURE FOR CONCRETE SLABS

(75) Inventors: Tapio Lehto, Vimpeli (FI); Pekka Kuusela, Vimpeli (FI)

(73) Assignee: Valisuomen Imubetoni Oy, Vimpeli (FI)

( * ) Notice: Subject to any disclaimer, the term of this patent is extended or adjusted under 35 U.S.C. 154(b) by 40 days.

(21) Appl. No.: 10/467,071

(22) PCT Filed: Feb. 5, 2002

(86) PCT No.: PCT/FI02/00084

§ 371 (c)(1),
(2), (4) Date: Aug. 5, 2003

(87) PCT Pub. No.: WO02/063115

PCT Pub. Date: Aug. 15, 2002

(65) Prior Publication Data

US 2004/0062605 A1 Apr. 1, 2004

(30) Foreign Application Priority Data

Feb. 5, 2001 (FI) ..... 20010213

(51) Int. Cl.[7] ..... E01C 11/02
(52) U.S. Cl. ..... 404/47; 404/49; 404/68
(58) Field of Search ..... 404/47, 49, 53, 404/54, 68, 70, 134, 135, 65; 14/73.1

(56) References Cited

U.S. PATENT DOCUMENTS 2,230,303 A * 2/1941 Leguillon ..... 404/65
3,059,553 A * 10/1962 Woolley ..... 404/62
3,068,763 A 12/1962 Harza
3,276,335 A 10/1966 Middlestadt
3,396,640 A 8/1968 Fujihara
3,455,215 A 7/1969 Webb
4,012,159 A 3/1977 Berry
4,295,315 A * 10/1981 Lynn-Jones et al. ..... 52/396.05
4,490,067 A * 12/1984 Dahowski ..... 404/4
4,522,531 A * 6/1985 Thomsen et al. ..... 404/2
4,648,739 A * 3/1987 Thomsen ..... 404/2
4,651,488 A * 3/1987 Nicholas et al. ..... 52/396.02
4,674,912 A * 6/1987 Buckenauer ..... 404/56

* cited by examiner

*Primary Examiner*—Robert E. Bezzuto
*Assistant Examiner*—Raymond W Addie
(74) *Attorney, Agent, or Firm*—Young & Thompson

(57) ABSTRACT

An expansion joint structure to be placed between adjacent concrete slabs in a concrete slab system comprises a first profile element to be attached to an edge of a first concrete slab, and a second profile element to be attached to an edge of a second concrete slab, the profile elements being joined together by removable connecting strips such that there is a gap between the profile elements. The profile elements and connecting strips constitute a single continuous entity of extruded aluminum profile. The connecting strips are attached by outer edges to the profile elements through very thin neck portions that keep the elements together during the pouring of the slab. The expansion joint structure is positioned on the concreting base at the correct height prior to the pouring of the concrete slabs.

13 Claims, 2 Drawing Sheets

EXPANSION JOINT STRUCTURE FOR CONCRETE SLABS

BACKGROUND OF THE INVENTION

The invention relates to an expansion joint reinforcing structure for concrete slabs, comprising a first profile element to be attached to an edge of a first concrete slab, and a second profile element to be attached to an edge of a second, adjacent, concrete slab, said profile elements being joined together by at least one removable connecting strip such that there is a gap between the profile elements.

A widely used flooring structure in construction engineering is a concrete slab on grade, poured either direct on top of leveled soil or on top of a thermal insulator layer placed on the ground. Shrinkage of the concrete as well as thermal contraction and expansion tend to cause cracking in large slabs, whereby large slabs have to be divided into smaller sub-slabs by means of expansion or isolation joints. Deformations caused by shrinkage and thermal expansion and contraction will thus occur at the expansion joints and the slabs will otherwise remain crackless.

The simplest way of making expansion joints is to first pour a whole concrete slab and then, as setting has begun, divide it into smaller sections separated by grooves saw-cut on the surface of the slab by means of a diamond-blade saw. Subsequent contraction cracks will then appear at the grooves. The edges of saw-cut expansion joints are prone to crumbling and chipping, so they are totally unsuitable for heavily loaded floors. From the prior art we also know of expansion joint structures embedded in concrete with metal reinforcements at the edges of the expansion joints. One such structure is disclosed in the patent document FI 952994. The reinforcing joint structure is embedded in fresh concrete, and the joint between the flat steel bars is saw-cut open once the concrete has hardened. The joint is then filled with elastic material. The installation of such an expansion joint structure is tedious, because the joint structure has to be pushed into already-leveled fresh concrete. Moreover, saw-cutting the expansion joint means extra work.

Reference documents GB 1139538, U.S. Pat. No. 3,068,763, U.S. Pat. No. 3,276,335, and U.S. Pat. No. 3,455,215 disclose expansion joint structures embedded in the surface of a concrete slab. These structures are weak and not intended to be anchored in the concreting base. Therefore, they cannot serve as construction joint forms or screed guides during the floating of the concrete slab. In most such solutions, the gap between the two halves of the joint structure is closed using a flexible sealing agent attached to the joint structure and remaining partly within the cast. Such a flexible and soft sealing agent wears and breaks easily so that the joint begins to leak. Moreover, the sealing agent within the cast cannot be replaced.

Patent document FI 982675 discloses an expansion joint structure with a sheetmetal profile and metallic angle profile loosely attached to the sheetmetal profile by rivets or flexible bolts, for example. The sheetmetal profile simultaneously serves as a form for the slab to be cast. The sheetmetal profile and angle profile both have protruding bondage means through which they become attached to the concrete. The joint structure is placed such that it rests on corrugated steel rods driven into the concreting base at correct locations and heights, or on concrete legs cast on the concreting base, after which the slab is poured. As the concrete shrinks, the angle profile comes off the sheetmetal profile, thereby opening an expansion joint between the profiles.

A drawback of this solution is the poor functionality of the expansion joint. An expansion joint caused solely by the shrinkage of concrete is so narrow that it cannot be sealed with a sealing agent. This means that the expansion joint will not be watertight. In order to achieve a sufficient joint width the gap between the sheetmetal profile and angle profile has to be enlarged with the result that the gap will be filled with concrete when the concrete is poured. Therefore, prior to sealant installation, the gap has to be thoroughly cleaned with e.g. a grinder, adding to the building costs. In spite of the cleaning, concrete dust and crumbles often remain in the gap, affecting the adhesion of the sealant to the walls of the gap. It is therefore difficult to male the expansion joint watertight. Moreover, it is somewhat difficult to anchor the expansion joint structure to the concreting base and set it at the correct height.

SUMMARY OF THE INVENTION

An object of the invention is to provide a new expansion joint structure which reduces the drawbacks and disadvantages associated with expansion joints according to the prior art.

An expansion joint structure according to the invention is a reinforcing structure designed to be placed between individual slabs of a concrete slab system, comprising a first profile element to be attached to an edge of a first concrete slab, and a second profile element to be attached to an edge of a second, adjacent, concrete slab. The profile elements are joined together by removable connecting strips such that there is a clear gap between the profile elements. In an expansion joint structure according to the invention the profile elements and connecting strips constitute a single continuous entity of extruded aluminum profile. The connecting strips are attached by their edges to the profile elements through very thin necks that keep the elements together during the casting of the slab. When the concrete has hardened enough, the connecting strips are torn off whereby the thin necks will break and the connection between the profile elements disappears. An expansion joint structure according to the invention is positioned on the concreting base at the correct height prior to the casting of the concrete slabs. As the concrete sets, the joint structure remains within the slab system and becomes part of the cast. During casting, the connecting strips block the gap between the profile elements and keep it clean. When the concrete has hardened enough, the connecting strips are torn off whereby the profile elements will become disconnected. The resulting gap is filled with elastic sealant, completing the expansion joint.

An advantage of the invention is that the expansion joint can be completed quicker. Saw-cutting and cleaning the joints, which tasks are required in expansion joint construction techniques according to the prior art, are no longer required when using the structure according to the invention, resulting in savings in construction costs.

Another advantage of the invention is that it enhances the quality of expansion joints. Using the structure according to the invention, the gap between the profile elements is clean, smooth-edged, and wide enough so that an elastic sealant can be easily installed in the gap and, moreover, the adhesion between the sealant and gap walls is good. This way, the expansion joint will be watertight, adding to the durability and life of the joint.

A further advantage of the invention is that it makes the maintenance of the expansion joint easier. The sealant in the wide gap between the profile elements can be easily repaired or replaced, if necessary, should the sealant come off the walls of the gap or otherwise lose its watertightness.

Yet another advantage of the invention is that it has several functions. An expansion joint structure supported on the concreting base at a correct installation height serves as a screed mark during the casting of the concrete and, furthermore, it can also serve as a construction joint form.

A still further advantage of the invention is that it is simple in construction, cheap to manufacture and well suited to industrial production.

BRIEF DESCRIPTION OF THE DRAWINGS

The invention will be now described in detail. Reference is made to the accompanying drawings in which.

DETAILED DESCRIPTION OF THE PREFERRED EMBODIMENTS

Figure 1:
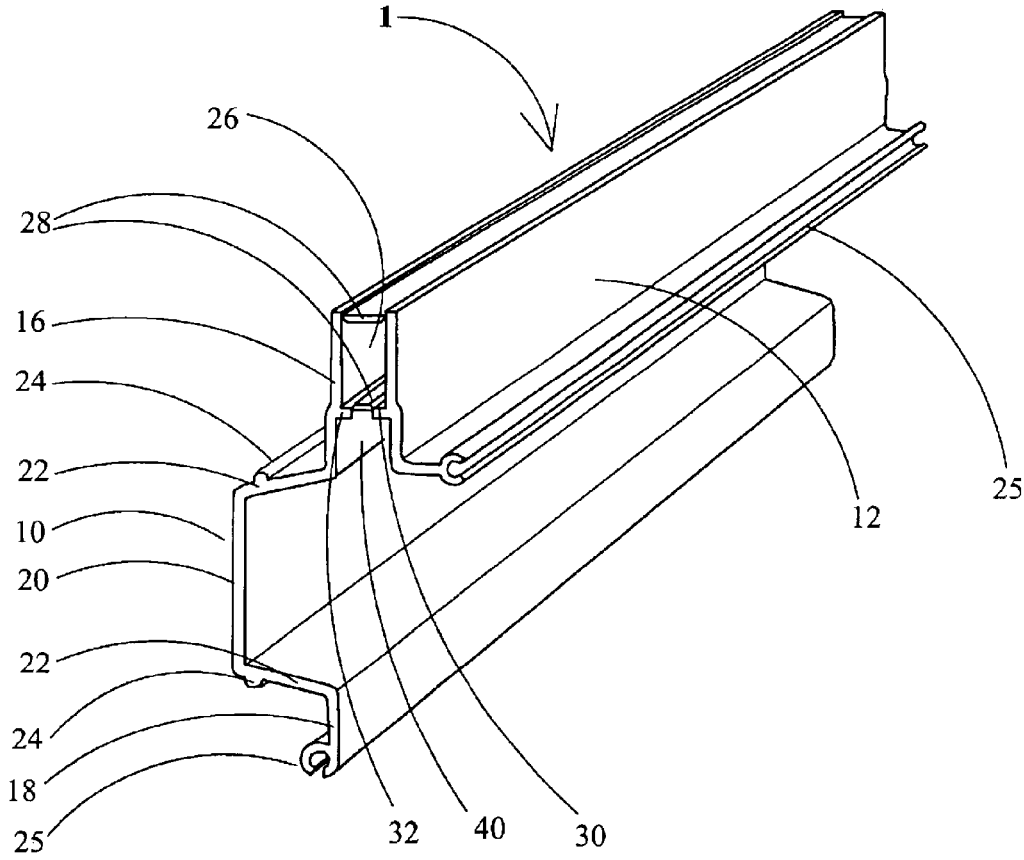
FIG. 1 is a diagonal front view of an expansion joint structure according to the invention.

FIG. 1 shows, by way of example, a diagonal front view of an expansion joint structure 1 according to the invention. The expansion joint structure is depicted in vertical position, i.e. in the position in which it will be installed. The expansion joint structure comprises two parallel metal profiles: a first profile element 10 and a second profile element 12. The first profile element is a metal profile having a cross sectional shape which resembles a so-called trapezoid, comprising three substantially parallel planar portions: upper portion 16, lower portion 18, and middle portion 20. The upper and lower portions are in substantially the same vertical plane, but the middle portion is clearly in a different plane than the upper and lower portions. The middle portion is connected to the upper and lower portions through slanted flange portions 22 such that the portions together constitute a single metal profile. On one surface of each flange portion there is a short bonding projections 24 to increase the bonding of the first profile element to the concrete.

The second profile element 12 is an L-shaped metal profile attached parallel to the upper portion 16 of the first profile element by means of two removable connecting strips 28 in the longitudinal direction of the profile elements. The attachment is realized such that a first flank of the second profile element stands upright parallel to the upper portion of the first profile element, and a second flank of the second profile element lies horizontally, projecting away from the first profile element. The connecting strips are metallic strips attached by their first edges to the first profile element and by their second edges to the second profile element. Between the first flank of the second profile element 12 and the upper portion 16 of the first profile element 10 there is a gap 26 the width of which can be set as desired at the manufacturing stage of the expansion joint structure. Advantageously the width of the gap is about 10 mm. On the first flank of the second profile element there is a longitudinal ledge 30 and, conversely, on the upper portion 16 of the first profile element there is a corresponding ledge 32 such that the two ledges face each other in the gap 26.

The first and second profile elements are interconnected by a first connecting strip 28 at the upper edge of the gap 26, and by a second connecting strip at the middle of the gap where the ledges 30 and 32 are located. At the upper portion of the gap 26, in the longitudinal direction of the expansion joint structure, there is thus formed a closed cavity confined by the profile elements 10, 12 and connecting strips 28. At the lower portion of the gap there is formed a channel 40 confined by the profile elements and lower connecting strip such that the downward-facing side of the channel is open. Advantageously the channel is square-shaped and has a width of about 12 mm. Additionally, there is, in the longitudinal direction of the profile, an end conduit 25 at the free end of the horizontal flank of the second profile element and at the free end of the lower portion 18 of the first profile element 10, which end conduit has a cross-section resembling a portion of a circular arc. Adjacent extension joint structures are interconnected at their ends by means of spring pins placed at the end conduits, or using short bars (not shown) fitted in the end conduits so that the bars extend across the joining point and prevent the ends of the expansion joint structures from moving in relation to each other. The end conduits also enhance the bonding of the profile elements to the concrete. To further enhance the bonding, the profile element surfaces intended to be in contact with the concrete may be roughened.

In an expansion joint structure according to the invention the profile elements 10, 12 and the connecting strips 28 constitute a single extruded aluminum profile. The connecting strips are attached to the profile elements through very thin necks which keep the elements together during the casting of the slab. The necks-are so thin that they can be broken by hand. Thus the connecting strips can be detached from the profile elements simply by tearing them off by hand when the concrete has hardened enough. Expansion joint structures can be manufactured in different sizes for different uses and environments. Advantageously the overall height of an expansion joint structure is about 10 to 15 cm. The thickness of a profile element wall is advantageously about 2 to 3 mm. The length of an expansion joint structure can be chosen on the basis of manufacturing, transport, and installation criteria, for example. Advantageously the length of an expansion joint structure is 3 to 5 meters. During installation, the profile elements are kept together by the connecting strips 28. At the same time the connecting strips prevent fresh concrete from entering the gap 26, thus keeping the gap clean during the casting phase. As soon as the concrete surface has been leveled and floated, the connecting strips are torn off the profile elements so that deformations caused by the contraction of the slab can occur freely. After that, an elastic sealant 72 (FIG. 3) is installed in the gap. Optionally, after removing the connecting strips a temporary removable protecting band can be installed in the gap for the duration of the drying of the slab, in which case the sealant 72 proper is installed later when the concrete has hardened enough.

Figure 2:
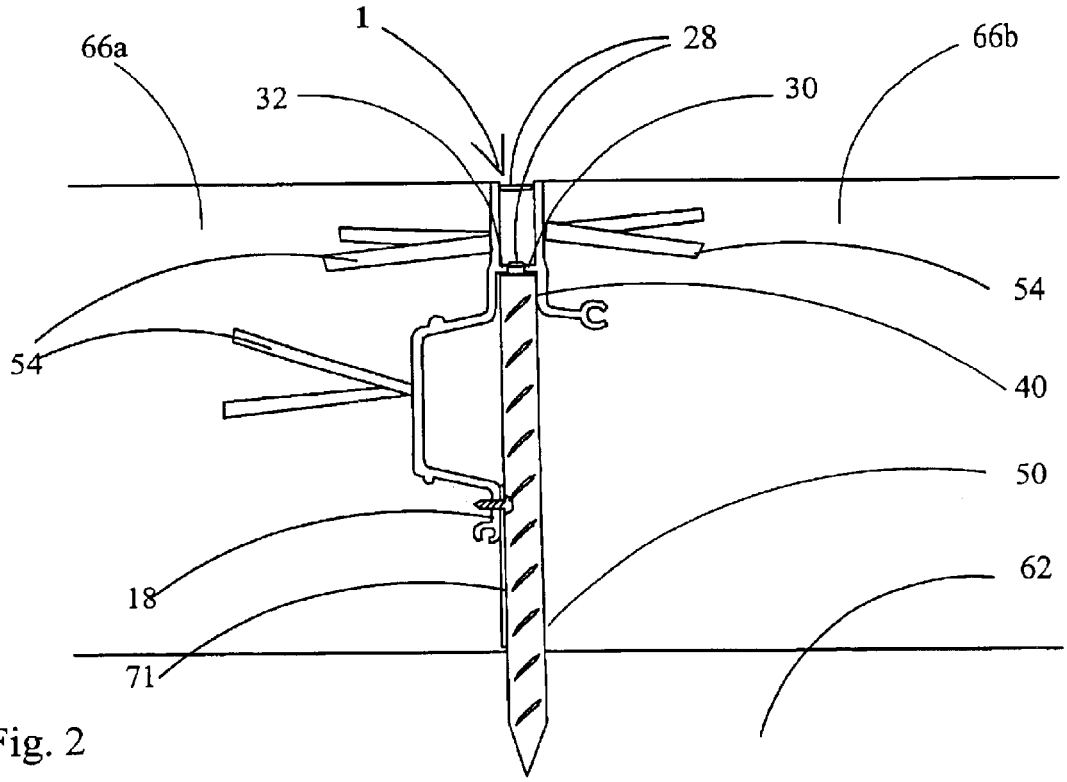
FIG. 2 is a cross-section view of an expansion joint of a freshly cast concrete slab with an expansion joint structure according to the invention.

FIG. 2 shows, by way of example, an expansion joint structure 1 according to the invention cast-in in a concrete slab system. FIG. 2 depicts the situation immediately after the casting of the slab. Installation of the expansion joint structure is begun by driving into the concreting base 62 mounting rods 50, each of which has one end sharp, in an upright position, advantageously at about one-meter intervals. The mounting rods 50 are advantageously about 40-cm-long bits of ordinary 10-mm corrugated steel rod. The mounting rods are aligned in a straight line at the expansion joint with the help of an alignment wire, and their top ends are positioned at the exact height specified, advantageously using a leveling instrument or laser beam. The expansion joint structure is then mounted on the mounting rods such that the ends of the mounting rods go into the channel 40 between the profile elements, and the edges of the ledges 30, 32 rest on the ends of the rods. An alternative advantageous method of supporting the expansion joint structure is to cast small concrete legs at about one-meter intervals along the joint with the help of an alignment wire. After that, the expansion joint structure is aligned on top of the concrete legs and adjusted at the exact specified height using a laser beam, for example. The slab proper is cast when the concrete legs have hardened enough, i.e. the next day in most cases.

The upper edge of the expansion joint structure is fixed prior to the casting of the slab proper, in one of the ways discussed above, as precisely as possible to the height corresponding to the upper surface of the slab to be poured so that the expansion joint structure can be utilized e.g. as a screed mark in the leveling of the slab surface when the slab is poured. If the gap between the concreting base 62 and the lower edge of the expansion joint structure 1 is large, it can be covered with a separate boardlike barrier 71 advantageously screwed or riveted onto the lower portion 18 of the first profile element.

A concrete slab is cast, depending on the size of the slab and other factors, either in one pour or in several pours. If the slab is small, the concrete slabs 66*a*, 66*b* on both sides of the expansion joint structure can be cast in one pour. Large slabs usually cannot be cast in one pour, but the concreting has to be done over a span of several days. In such a case the concreting can be interrupted at the expansion joint, and pouring can be continued the following day. The expansion joint structure serves then also as a construction joint form. As the concrete hardens, the expansion joint structure becomes part of the concrete slab. The trapezoid shape of the first profile element 10 causes a wedge-like concrete dowel to be formed in the joint between the concrete slabs 66*a*, 66*b* which concrete dowel receives shear stresses present at the joint. In order to enhance the bondage of the profile elements to the concrete cast, bondage strips 54 are attached to the profile elements at the installation phase of the joint structure. The bondage strips are V-shaped aluminum strips attached, advantageously by means of welding, by their ends to a surface of a profile element. Naturally, other kinds of bondage elements may be used as well, such as e.g. threaded bars attached by a bolt to a hole drilled through the wall of a profile element.

Figure 3:
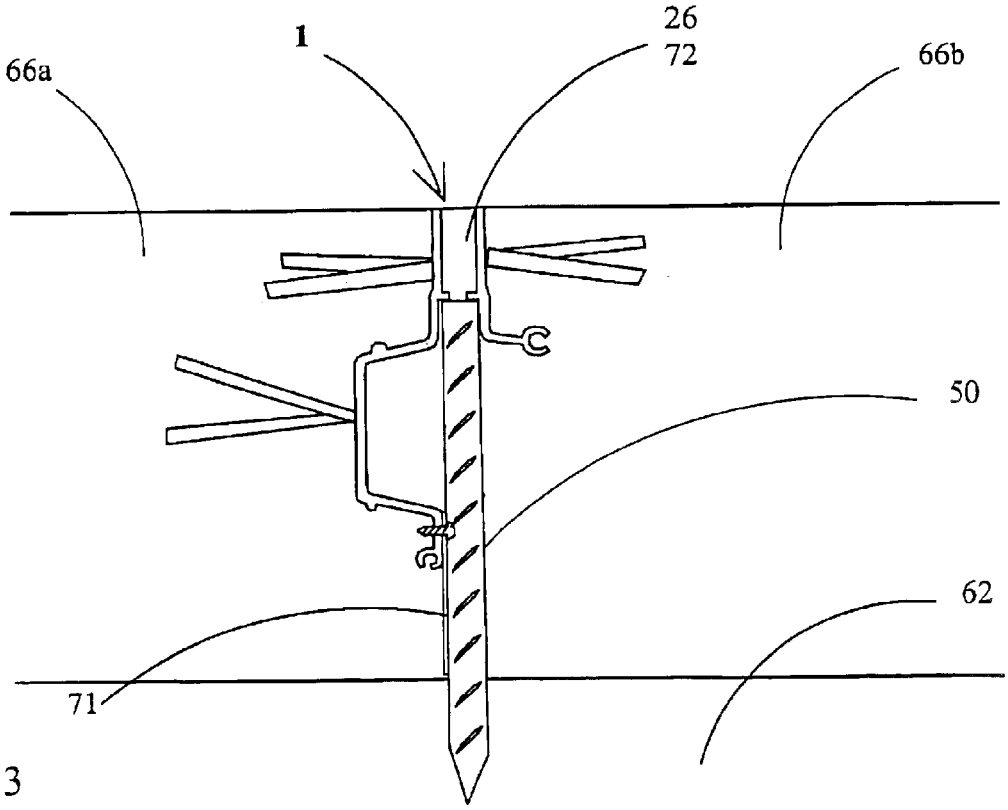
FIG. 3 is a cross-section view of an expansion joint of a hardened concrete slab with an expansion joint structure according to the invention.

FIG. 3 shows, by way of example, a cross section of an expansion joint structure 1 according to the invention cast-in in a concrete slab. FIG. 3 depicts a situation where the slab is at least partly set and contraction in the slab has begun. When extra water exits, the slabs 66*a*, 66*b* contract. The slab edges will then withdraw towards their respective contraction centers, leaving a gap between the slabs. When using, an expansion joint structure according to the invention, the first profile element 10 will bond to the first concrete slab 66*a*, and the second profile element 12 to the second concrete slab 66*b*, whereby deformations caused by slab contraction will primarily occur at the gap 26. In order to allow deformations caused by contraction to occur freely, the connecting strips 28 should be removed as soon as possible, advantageously immediately after the floating. After that, the gap 26 is filled with elastic sealant 72 which will conform to the movements of the slab edges. The sealing strips protected the gap during the pouring work so that the sealant will readily adhere to the clean walls of the gap. The expansion joint will thus be watertight. As the concrete shrinks, the end surface of the second slab 66*b* will come off the first profile element 10 and barrier 71, thus resulting in a tongue-and-groove structure at the slab joint which will transfer shear stresses.

Above we described a few advantageous embodiments of an expansion joint structure according to the invention. The invention is not limited to the solutions described above, but the inventional idea can be applied in numerous ways within the scope defined by the claims attached hereto.

What is claimed is:

1. An expansion joint structure for concrete slabs, comprising:

a first profile element to be attached to an edge of a first concrete slab, and a second profile element to be attached to an edge of a second, adjacent, concrete slab, said profile elements being joined together by at least one removable connecting strip such that there is a gap between the profile elements, wherein the first profile element and second profile element and the at least one connecting strip form a single continuous aluminum profile, and wherein the at least one connecting strip is attached by a first edge to the first profile element and by a second edge to the second profile element through respective necks having a reduced thickness with respect to a central portion of the at least one connecting strip such that the at least one connecting strip can be torn off.

2. The expansion joint structure according to claim 1, wherein there are two connecting strips and a first connecting strip is placed at an upper edge of the gap and a second connecting strip is placed at a middle or lower portion of the gap.

3. The expansion joint structure according to claim 1, wherein, a width of the gap between the first and second profile elements is about 10 millimeters.

4. The expansion joint structure according to claim 1 wherein at least one of the first profile element and the second profile element comprise means for coupling expansion joint structures together.

5. The expansion joint structure according to claim 1, wherein the first profile element is designed to serve as a concreting form or construction joint form.

6. The expansion joint structure according to claim 1, wherein a cross section of the first profile element is shaped such that the first profile element provides an expansion joint form which can transfer shear stresses.

7. The expansion joint structure according to claim 1 wherein at least one of the first profile element and the second profile element comprise bondage elements in order to enhance the bonding of the profile elements to the concrete slabs.

8. The expansion joint structure according to claim 1, wherein a sealant is capable of being inserted in the gap after removing the connecting strips.

9. An expansion joint structure for concrete slabs, comprising:

a first profile element to be attached to an edge of a first concrete slab;

a second profile element to be attached to an edge of a second, adjacent, concrete slab; and a removable connecting strip connected between said first and second profile elements that forms a gap between said first and second profile elements, wherein said connecting strip has first and second edges and a center between said first and second edges and is attached by said first edge to said first profile element and by said second edge to said second profile element; said first and second edges being thinner than said center.

10. The expansion joint structure according to claim 9, wherein there are two connecting strips and a first connecting strip is at an upper edge of the gap and a second connecting strip is placed at a lower portion of the gap.

11. The expansion joint structure according to claim 9, wherein a cross section of the first profile element is substantially trapezoidal in order to transfer shear stresses.

12. The expansion joint structure according to claim 9, wherein at least one of said first and second profile elements include bondage elements.

13. The expansion joint structure according to claim 9, wherein a sealant is insertable into the gap when the connecting strip has been removed.

* * * * *